US006455218B2

(12) United States Patent
Isonaka et al.

(10) Patent No.: US 6,455,218 B2
(45) Date of Patent: Sep. 24, 2002

(54) DEVELOPER FOR ELECTROSTATIC IMAGE DEVELOPMENT AND IMAGE FORMING METHOD USING THE SAME

(75) Inventors: Takeshi Isonaka, Ageo; Toshiro Kogawara, Iwatsuki; Katsunori Ohba, Oyama; Shinji Amaya, Saitama, all of (JP)

(73) Assignee: Dainippon Ink and Chemicals, Inc., Tokyo (JP)

( * ) Notice: Subject to any disclaimer, the term of this patent is extended or adjusted under 35 U.S.C. 154(b) by 0 days.

(21) Appl. No.: 09/875,176

(22) Filed: Jun. 7, 2001

(30) Foreign Application Priority Data

Jun. 9, 2000 (JP) ..... 2000-173579

(51) Int. Cl.[7] ..... G03G 9/113
(52) U.S. Cl. ..... 430/111.35; 430/120
(58) Field of Search ..... 430/108.6, 111.1, 430/111.32, 111.33, 137.18, 111.35, 120

(56) References Cited

U.S. PATENT DOCUMENTS 4,272,601 A * 6/1981 Tokura et al. ..... 430/111.1
5,354,638 A * 10/1994 Harada ..... 430/111.32
6,090,517 A * 7/2000 Tamura et al. ..... 430/111.33

FOREIGN PATENT DOCUMENTS

JP 4-324457 11/1992
JP 4-358168 12/1992
JP 7-219281 8/1995
JP 8-179570 7/1996

* cited by examiner

*Primary Examiner*—John Goodrow
(74) *Attorney, Agent, or Firm*—Armstrong, Westerman & Hattori, LLP

(57) ABSTRACT

The present invention relates to a developer for electrostatic image development comprising: a toner for electrostatic image development which comprises a resin and a colorant; and a carrier formed by a carrier core material and a resin layer including a resistance control agent which is formed on the surface of the carrier core material, wherein the resin layer of the carrier has a concentration gradient of the resistance control agent toward the thickness direction of the resin layer, a concentration of the resistance control agent is the highest in the vicinity of the carrier core material, and is gradually lowered toward the surface of the resin layer, and the resistance control agent is present on the surface of the resin layer, as well as relates to an image forming method, wherein it comprises a step of developing an electrostatic image at a developing speed of 20 m/min or higher, by means of employing the developer for electrostatic image development. The developer for electrostatic image development of the invention exhibits a stable development and transfer behavior without any variation of triboelectric charging performance, electric resistance, or the like, even when used as a two-component developer, and in addition, affords a printed image with high image quality and high grade without any fogging.

7 Claims, No Drawings

DEVELOPER FOR ELECTROSTATIC IMAGE DEVELOPMENT AND IMAGE FORMING METHOD USING THE SAME

BACKGROUND OF THE INVENTION

1. Field of the Invention

The present invention relates to a developer for electrostatic image development which is employed in electrophotographic methods, electrostatic recording methods, and electrostatic printing methods, and relates to an image forming method using the developer.

2. Description of the Related Art

Various electrophotographic methods have been disclosed in, for example, U.S. Pat. No. 2,297,691, Japanese Examined Patent Application, Second Publication No. Sho 42-23910, and Japanese Examined Patent Application, Second Publication No. Sho 43-24748. Commonly, an electrostatic latent image is formed on an electrostatic latent image bearing medium such as a photoconductive photosensitive medium or the like by means of charge or light exposure, and then this electrostatic latent image is developed employing a toner composition containing a colorant in a binder resin. The resulting toner image is transferred to a support medium such as transfer paper or the like and is fixed, and a visible image is thus formed.

In addition, many development methods incorporated as part of the electrophotographic method are known, and these are roughly classified into a two-component development method which employs, as a developer, a mixture of toner and a carrier comprising microparticles (20–500 $\mu$m) such as iron powder, ferrite powder, nickel powder, glass powder and the like, and a single-component development method employing a developer made of a toner only.

Typical examples of the two-component development method include a cascade method described in U.S. Pat. No. 2,618,552 and a magnetic brush development method described in U.S. Pat. No. 2,874,063. In these methods, a carrier is partialyl responsible for functions such as stirring, transfer and charging of the developer, and therefore, the functions of the carrier and those of the toner are clearly separate. Accordingly, the two-component development method has been widely employed at present because it can control charging of the toner and form the developer layer relatively easily and also facilitates more rapid processing.

Although the carrier comprising iron powder, ferrite powder, or the like may afford a high image density by virtue of the low resistance thereof, it presents a number of problems including poor reproducibility of fine lines, poor charging property of the carrier due to the toner spent on the surface of the carrier, imperfection of the image caused by adhesion of the carrier on the photosensitive medium, and the like. On the other hand, the carrier comprising the core particles such as iron powders, ferrite powders, or the like which are coated with a resin composition may improve the reproducibility of fine lines since the carriers coated only with a resin which generally has a high resistance also have a high resistance, and the electric field strength is low at the time of development, affording the edge effects. However, by employing the carriers comprising the coated core particles, a uniform image cannot be obtained and an extreme degradation of the image density may be observed.

In order to prevent the high resistance of the carrier, a carrier having an appropriate resistance by means of dispersing a conductive agent such as a carbon black in a resin is commonly employed. A carrier having a conductive layer as a lower coating layer and a high resistance layer as an upper coating layer, as described in Japanese Unexamined Patent Application, First Publication No. Hei 4-324457; a carrier having a resin layer, as a lower coating layer, which has a thickness of 0.5 to 1.0 $\mu$m and includes a resistance control agent, and another resin layer, as an upper coating layer, which has a thickness of 0.1 to 0.5 $\mu$m and does not include any resistance control agents, as described in Japanese Unexamined Patent Application, First Publication No. Hei 4-358168; and a carrier wherein an insulating coating layer, as the first coating layer, which has a volume resistivity ranging from $10^8$ to $10^{11}$ Ωcm and a film thickness of 0.3 to 0.7 $\mu$m is formed on the surface of a core material particle, another insulating coating layer, as the second coating layer, which has a volume resistivity ranging from 1 to $10^4$ Ωcm and a film thickness of 0.05 to 0.4 $\mu$m is formed on the first coating layer, and an additional insulating coating layer, as the third coating layer, which has a volume resistivity ranging from $10^8$ to $10^{10}$ Ωcm and a film thickness of 0.5 to 1.0 $\mu$m is formed on the second coating layer, as described in Japanese Unexamined Patent Application, First Publication No. Hei 7-219281, have been proposed. In addition, in Japanese Unexamined Patent Application, First Publication No. Hei 8-179570, a carrier wherein a carrier core material is coated with a resin layer containing a carbon black, and subsequently, another resin layer is formed as a surface layer has been proposed.

However, the carriers proposed in these publications have a high resistance since the surface thereof is formed by an insulating layer which does not include any carbon black. Therefore, as described above, the electric field strength is low at the time of development, giving the edge effects. For this reason, the carriers described above cannot sufficiently overcome the problems in that a uniform image cannot be obtained and in that an extreme degradation of the image density may be observed.

In addition, in order to clarify the problems described above, heretofore, a means for optimizing the resistance value of the carrier by including an appropriate amount of a carbon black in a resin for coating the carrier core material, and coating the carrier core material with a resin layer having a constant concentration of the carbon black from the vicinity of the carrier core material to the surface of the resin layer, has been proposed. According to this method, an appropriate resistance value of the carrier can be obtained at the initial stage of printing. However, in a continuous printing for a long period of time, peeling of the resin layer which corresponds to a coating agent for the carrier core material, caused by the stirring in the interior of the development device, may occur, or on the other hand, adhesion of the toner components on the surface of the carrier (hereinafter, referred to as spent toner) may occur, resulting in a large change in the surface characteristics of the carrier. As a result, the resistance value of the carrier at the initial stage of printing may be different from that after printing for a long period of time, and for this reason, printed matter of a uniform quality cannot be obtained.

In particular, recently, due to an improvement of the printing speed, exceeding 20 m/min, the stress caused by the stirring in the interior of the development device is increased, and even in printing for a long period of time, a constant quality in the printed matter is desired. However, the developer which can exhibit a high quality satisfying these properties could not be obtained heretofore.

BRIEF SUMMARY OF THE INVENTION

The present invention aims to overcome the problems described above in a developer for electrostatic image development.

That is, an object of the present invention is to provide a developer for electrostatic image development, which exhibits a stable development and transfer behavior without any variation in triboelectric charging performance, electric resistance, or the like, even when used as a two-component developer.

In addition, another object of the present invention is to provide a developer for electrostatic image development, which affords a printed image with high image quality and high grade without any fogging, by virtue of rapidly reaching the predetermined charge amount when used as a two-component developer.

In addition, another object of the present invention is to provide a developer for electrostatic image development, which exhibits good triboelectric charging performance and good electric resistance, even during high speed printing, in particular, high-speed printing at high speeds exceeding 20 m/min when used as a two-component developer.

Furthermore, another object of the present invention is to provide an image forming method wherein a high speed printing at high speeds exceeding 20 m/min can be carried out employing the two-component developer described above.

As a result of diligent research with regard to various carriers, the present inventors have found that the problems described above may be solved by a carrier having a specific resin layer for coating the carrier.

That is, in order to solve the problems described above, the present invention provides a developer for electrostatic image development comprising: a toner for electrostatic image development which comprises a resin and a colorant; and a carrier formed by a carrier core material and a resin layer including a resistance control agent which is formed on the surface of the carrier core material, wherein the resin layer of the carrier has a concentration gradient of the resistance control agent toward the thickness direction of the resin layer, a concentration of the resistance control agent is the highest in the vicinity of the carrier core material, and is gradually lowered toward the surface of the resin layer, and the resistance control agent is present on the surface of the resin layer, as well as provides a high-speed image forming method employing the developer.

That is, the resistance control agent is present in the resin layer located on the surface of the carrier according to the present invention, and for this reason, the carrier of the present invention has a relatively low resistance as compared to a carrier coated by a layer including only a resin. Therefore, printed matter which has a sufficient image density and a high image quality without any edge effects may be obtained in the initial stage of printing. In addition, during printing for a long period of time, a balance is necessary between an increase in the resistance due to the spent toner and a decrease in the resistance due to an exposure of the carrier core material caused by peeling of the resin layer located on the surface of the carrier. It has been found that the balance between them can be maintained by virtue of employing the carrier coated by a resin layer having a concentration gradient of the resistance control agent toward the thickness direction of the resin layer, thus achieving the present invention.

In the case where a high stress is exerted on the carrier, the speed of the toner spent is higher than that of the peeling of the resin layer of the carrier, that is, the speed of increase in the resistance is high. In order to solve this problem, by the means described above, that is, by gradually increasing the concentration of the resistance control agent included in the resin layer, as it is close to the vicinity of the carrier core material, the resin layer having the higher concentration of the resistance control agent is exposed for each peeling of a part of the surface of the resin layer, thus exhibiting the effects to prevent an increase in resistance. Therefore, the constant resistance value of the carrier may be maintained even during printing for a long period of time. Such effects are greatly exerted in a development device having, in particular, a developing speed of 20 m/min or higher.

DETAILED DESCRIPTION OF THE INVENTION

As the binder resin employed in the present invention, any binder resins which are commonly employed in a toner may be employed and they are not particularly restricted. Examples thereof include a polystyrene, a styrene-(meth) acrylate copolymer, an olefin resin, a polyester resin, an amide resin, a polycarbonate resin, an epoxy resin, as well as a grafted polymer thereof and a mixture thereof, and the like.

Among these binder resins, a polyester resin and a styrene-(meth)acrylate resin may be preferably employed, considering a charging stability, storage stability, fixing properties, color reproducibility in the case of employing as a resin for color toner containing colored organic pigments, and the like.

The polyester resin employed in the present invention is obtained by, for example, dehydration condensation of dicarboxylic acid and diol according to a conventional method. As an example of dicarboxylic acids, mention may be made of phthalic anhydride, terephthalic acid, isophthalic acid, orthophthalic acid, adipic acid, maleic acid, maleic anhydride, fumaric acid, itaconic acid, citraconic acid, hexahydrophthalic anhydride, tetrahydrophthalic anhydride, cyclohexane dicarboxylic acid, succinic acid, malonic acid, glutaric acid, azelaic acid, sebacic acid, and the like, as well as derivatives thereof.

In addition, as an example of diols, mention may be made of ethylene glycol, diethylene glycol, propylene glycol, dipropylene glycol, tripropylene glycol, butane diol, pentane diol, hexane diol, bisphenol A, polyoxyethylene-(2.0)-2,2-bis(4-hydroxyphenyl)propane and derivatives thereof, polyoxypropylene-(2.0)-2,2-bis(4-hydroxyphenyl)propane, polyoxypropylene-(2.2)-polyoxyethylene-(2.0)-2,2-bis(4-hydroxyphenyl)propane, polyoxypropylene-(6)-2,2-bis(4-hydroxyphenyl)propane, polyoxypropylene-(2.2)-2,2-bis(4-hydroxyphenyl)propane, polyoxypropylene-(2.4)-2,2-bis(4-hydroxyphenyl)propane, polyoxypropylene-(3.3)-2,2-bis(4-hydroxyphenyl)propane and derivatives thereof, and the like.

In addition, the diols such as polyethylene glycol, polypropylene glycol, ethylene oxide-propylene oxide random copolymer diol, ethylene oxide-propylene oxide block copolymer diol, ethylene oxide-tetrahydrofuran copolymer diol, polycaprolactone diol, and the like may also be employed.

If necessary, there can be employed aromatic carboxylic acids having three or more functional groups such as trimellitic acid, trimellitic anhydride, pyromellitic acid, pyromellitic anhydride, and the like, as well as derivatives thereof; alcohols having three or more functional groups such as sorbitol, 1,2,3,6-hexane tetraol, 1,4-sorbitan, pentaerythritol, 1,2,4-butane triol, 1,2,5-pentane triol, glycerol, 2-methylpropane triol, 2-methyl-1,2,4-butane triol, trimethylol ethane, trimethylol propane, 1,3,5-trimethylol benzene, and the like; polyvalent epoxy compounds having three or more functional groups such as bisphenol A type epoxy resin, bisphenol F type epoxy resin, ethylene glycol diglycidyl ether, hydroquinone diglycidyl ether, N,N-diglycidylaniline, glycerol triglycidyl ether, trimethylolpropane triglycidyl ether, trimethylolethane triglycidyl ether, pentaerythritol tetraglycidyl ether, cresol novolak type epoxy resin, phenol novolak type epoxy resin, polymers or copolymers of vinyl compounds having an epoxy group, epoxylated resorcinol-acetone condensate, partially epoxylated polybutadiene, one or more semi-dry or dry fatty ester epoxy compounds, and the like, together with the dicarboxylic acids and diols described above.

The polyester resin in the present invention may be obtained by carrying out a dehydration condensation reaction or an ester exchange reaction employing the raw material components described above in the presence of a catalyst. The reaction temperature and reaction period are not particularly restricted; however, these are normally at a temperature in a range of 150 to 300° C. and for 2 to 24 hours.

Examples of the catalyst which may be employed when conducting the reaction described above include, for example, zinc oxide, tin (I) oxide, dibutyltin oxide, dibutyltin dilaurate, and the like.

The polyester resin which may be employed in the present invention may have an appropriate glass transition temperature and appropriate melt viscosity properties suited for use in the toner for two-component development. The polyester resin having the temperature in a range of 95° C. or higher when it has a melt viscosity of $1\times10^5$ poise is preferred since good fixing properties are exhibited. Among these resins, the resin having the temperature in a range of 95 to 170° C. when it has a melt viscosity of $1\times10^5$ poise is more preferable because of good fixing properties even at a low temperature, and the resin having the temperature in a range of 95 to 160° C. when it has a melt viscosity of $1\times10^5$ poise is most preferable.

The glass transition temperature (Tg) of the polyester resin preferably ranges from 40° C. or higher, and in particular, more preferably from 45 to 85° C.

The acid value is preferably in a range of 30 or less, and in particular, more preferably in a range of 10 or less. Provided that the acid value is too high, causing reduction of the charge amount. For this reason, the desired charge amount cannot be obtained.

In addition, examples of the styrene monomers for use in the styrene-(meth)acrylate copolymer employed in the present invention include, for example, styrene, α-methylstyrene, vinyltoluene, p-sulfonestyrene, dimethylaminomethylstyrene, and the like.

As an example of (meth)acrylate monomers, mention may be made of an alkyl (meth)acrylate such as methyl (meth) acrylate, ethyl (meth)acrylate, n-propyl (meth)acrylate, isopropyl (meth)acrylate, n-butyl (meth)acrylate, isobutyl (meth)acrylate, tert-butyl (meth)acrylate, octyl (meth) acrylate, 2-ethylhexyl (meth)acrylate, lauryl (meth)acrylate, or stearyl (meth)acrylate; an alicyclic (meth)acrylate such as cyclohexyl (meth)acrylate; an aromatic (meth)acrylate such as benzyl (meth)acrylate; a (meth)acrylate containing a hydroxyl group such as hydroxyethyl (meth)acrylate; a (meth)acrylate containing a phosphoric acid group such as (meth)acryloxyethyl phosphate; a (meth)acrylate containing one or more halogen atoms such as 2-chloroethyl (meth) acrylate, 2-hydroxy-3-chloropropyl (meth)acrylate, or 2,3-dibromopropyl (meth)acrylate; a (meth)acrylate containing an epoxy group such as glycidyl (meth)acrylate; a (meth) acrylate containing an ether group such as 2-methoxyethyl (meth)acrylate, or 2-ethoxyethyl (meth)acrylate; a (meth) acrylate containing a basic nitrogen atom or an amide group such as dimethylaminoethyl (meth)acrylate, or diethylaminoethyl (meth)acrylate; or the like.

In addition, an unsaturated compound copolymerizable therewith may be employed, as necessary. For example, a vinyl monomer containing a carboxyl group such as (meth) acrylic acid, itaconic acid, crotonic acid, maleic acid, or fumaric acid; a vinyl monomer containing a sulfonic group such as sulfoethylacrylamide; a vinyl monomer containing a nitrile group such as (meth)acrylonitrile; a vinyl monomer containing a ketone such as vinyl methyl ketone, or vinyl isopropenyl ketone; a vinyl monomer containing a basic nitrogen atom or an amide group such as N-vinylimidazole, 1-vinylpyrrol, 2-vinylquinoline, 4-vinylpyridine, N-vinyl 2-pyrrolidone, or N-vinylpiperidone; or the like may be employed.

In addition, a crosslinking agent may be employed in a range of 0.1 to 2% by weight with respect to the weight of the vinyl monomer described above. As an example of crosslinking agents, mention may be made of divinylbenzene, divinylnaphthalene, divinyl ether, ethylene glycol di(meth)acrylate, diethylene glycol di(meth)acrylate, triethylene glycol di(meth)acrylate, polyethylene glycol di(meth)acrylate, 1,3-butylene glycol di(meth)acrylate, 1,6-hexane glycol di(meth)acrylate, neopentyl glycol di(meth) acrylate, propylene glycol di(meth)acrylate, dipropylene glycol di(meth)acrylate, polypropylene glycol di(meth) acrylate, trimethylolpropane tri(meth)acrylate, tetramethylolmethane tetra(meth)acrylate, or the like.

Alternatively, a resin employing a styrene-(meth)acrylate copolymer wherein said vinyl monomer containing a carboxyl group is copolymerized may be crosslinked using a metal salt. Examples of the metal salt include a halide, a hydroxide, an oxide, a carbonate, a carboxylate, an alkoxylate, or a chelate compound of Al, Ba, Ca, Cd, Co, Cr, Cu, Fe, Hg, Mg, Mn, Ni, Pb, Sn, Sr, Zn, or the like. The crosslinking reaction may be carried out by heating and stirring in the presence of a solvent.

A method for preparing the styrene-(meth)acrylate copolymer may be carried out according to a conventional polymerization method, wherein a polymerization reaction is carried out in the presence of a polymerization catalyst, such as a solution polymerization, a suspension polymerization, or a cluster polymerization.

Examples of the polymerization catalyst include, for example, 2,2'-azobis(2,4-dimethylvaleronitrile), 2,2'-azobisisobutyronitrile, 1,1'-azobis(cyclohexane-1-carbonitrile), benzoyl peroxide, dibutyl peroxide, butyl peroxybenzoate, or the like. The amount thereof is preferably in a range of 0.1 to 10.0% by weight relative to the weight of the vinyl monomer component.

The styrene-(meth)acrylate copolymer resin employed in the present invention may have an appropriate glass transition temperature and appropriate melt viscosity properties suited for use in the toner for two-component development. The styrene-(meth)acrylate copolymer resin having the temperature in a range of 95° C. or higher when it has a melt viscosity of $1\times10^5$ poise is preferred since good fixing properties are exhibited. Among these resins, the resin having the temperature in a range of 95 to 170° C. when it has a melt viscosity of $1\times10^5$ poise is more preferable because of good fixing properties even at a low temperature, and the resin having the temperature in a range of 95 to 160° C. when it has a melt viscosity of $1\times10^5$ poise is most preferable.

The glass transition temperature (Tg) of the styrene-(meth)acrylate copolymer resin preferably ranges from 40° C. or higher. Among them, the resin having a Tg in a range of 45 to 85° C. is particularly, preferred.

The acid value is preferably in a range of 30 or less, and in particular, more preferably in a range of 15 or less. When the acid value is too high, reduction in the charge amount occurs, and therefore, the desired charge amount cannot be obtained.

As a colorant, for example, a carbon black, various organic pigments, inorganic pigments, dyes, or the like may be employed. While the colorants are not particularly restricted, as an example thereof, the following colorants may be mentioned.

As the colorants employed in the present invention, the conventional colorants may be mentioned. Examples of black colorants include carbon blacks which are classified by the manufacturing method, such as furnace black, channel black, acetylene black, thermal black, lamp black, Ketjen black, and the like; examples of blue colorants include the phthalocyanine C.I. Pigment Blue 15-3, the indanthrone C.I. Pigment Blue 60, and the like; examples of red colorants include the quinacridone C.I. Pigment Red 122, the azo C.I. Pigment Red 22, C.I. Pigment Red 48:1, C.I. Pigment Red 48:3, C.I. Pigment Red 57:1, and the like; yellow colorants include the azo C.I. Pigment Yellow 12, C.I. Pigment Yellow 13, C.I. Pigment Yellow 14, C.I. Pigment Yellow 17, C.I. Pigment Yellow 97, C.I. Pigment Yellow 155, the isoindolinone C.I. Pigment Yellow 110, the benzimidazolone C.I. Pigment Yellow 151, C.I. Pigment Yellow 154, C.I. Pigment Yellow 180, C.I. Pigment Yellow 185, and the like. The colorant may be employed alone or in combination of two or more thereof.

In the toner according to the present invention, the proportion by weight of the resin and the colorant is not particularly restricted. In general, the colorant may be employed in an amount of 1 to 30 parts by weight, and preferably in an amount of 1 to 10 parts by weight with respect to 100 parts by weight of the resin.

In addition, in order to prepare a color toner employing the colorants described above, it is preferable to employ a polyester resin with respect to superior color developability and superior transparency of the color image. The polyester resin is stronger compared to the styrene-acrylic resins, and for this reason, it can resist the stresses in a development device. In addition, the polyester resin has a low melting point. Therefore, it is suited for the resin for use in color toners.

As a positive charge type control agent employed in the present invention, a triphenylmethane dye, a nigrosine dye, a quaternary ammonium salt compound, or a resin containing an amino group, or the like may be employed. The use of both a nigrosine dye and a quaternary ammonium salt compound is particularly preferable. It is particularly preferable that at least one compound selected from the compounds represented by General formula (1), General formula (2), and General formula (3) having the structures shown below be employed as the quaternary ammonium salt compound. An example of the compounds having the structure shown in General formula (1) includes Bontron P-51 (produced by Orient Chemical Industries Incorporated), while examples of the compound of General formula (2) include TP-302, TP-415, and TP-610 (produced by Hodogaya Chemical Industries Co., Ltd.).

General formula (1)

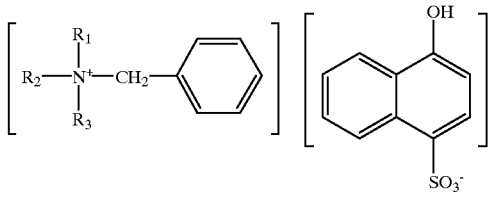

[In the formula, $R_1$ to $R_3$ represent a group of $C_nH_{2n+1}$, wherein n represents an integer ranging from 1 to 10 and $R_1$ to $R_3$ may be identical or different.]

General formula (2)

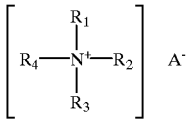

[In the formula, $R_1$, $R_2$, $R_3$, and $R_4$ each independently represents a hydrogen atom, an alkyl group having 1 to 22 carbon atoms, an alkenyl group having 2 to 22 carbon atoms, a non-substituted or substituted aromatic group having 6 to 20 carbon atoms, or an aralkyl group having 7 to 20 carbon atoms, and $A^-$ represents a molybdic anion or a tungstic anion, or a heteropolyacid anion containing a molybdenum or tungsten atom.]

General formula (3)

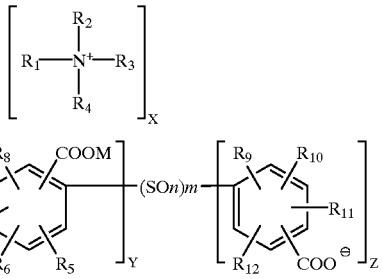

[In the formula, m represents 1, 2, or 3, n represents 0, 1, or 2, M represents a hydrogen atom or a monovalent metal ion, X and Z represent 1 or 2, and Y represents 0 or 1. In addition, Y is 1 and Z is 1 when X is 1, and Y is 0 and Z is 2 when X is 2, $R_5$ to $R_{12}$ represent a hydrogen atom, a straight-chain or branched, and saturated or unsaturated alkyl group having 1 to 30 carbon atoms, an alkoxy group having 1 to 4 carbon atoms, or a polyalkyloxylene group represented by the general formula: $(—(C_{2-5}\text{ alkylene})\text{-}O)_n—R$ (wherein R is a hydrogen atom or an alkyl or acyl group having 1 to 4 carbon atoms, and n is an integer in a range of 1 to 10), $R_1$, $R_2$, $R_3$ and $R_4$ represent a hydrogen atom, a straight-chain or branched, and saturated or unsaturated alkyl group having 1 to 30 carbon atoms, an oxyethyl group represented by the general formula: $(—CH_2—CH_2—O)_n—R$ (wherein R is a hydrogen atom or an alkyl or acyl group having 1 to 4 carbon atoms, and n is an integer in a range of 1 to 10), or a mononuclear or polynuclear alicyclic residue, a mononuclear or polynuclear aromatic residue, or a mononuclear or polynuclear aromatic aliphatic residue, having 5 to 12 carbon atoms.]

More concretely, the quaternary ammonium salt compounds include the following compounds.

Compound (1-1)

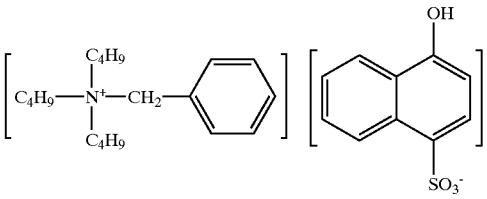

Compound (2-1)

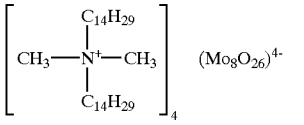

Compound (2-2)

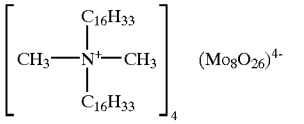

Compound (2-3)

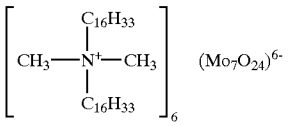

Compound (2-4)

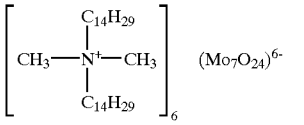

Compound (2-5)

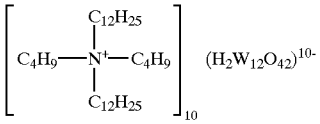

Compound (2-6)

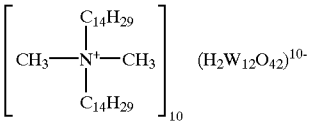

Compound (2-7)

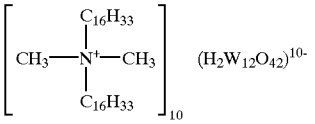

Compound (2-8)

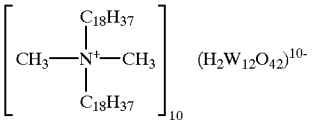

Compound (2-9)

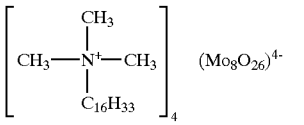

Compound (2-10)

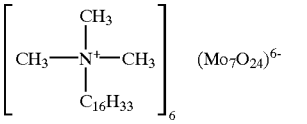

-continued

Compound (2-11)

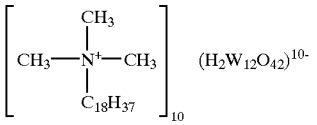

Compound (3-1)

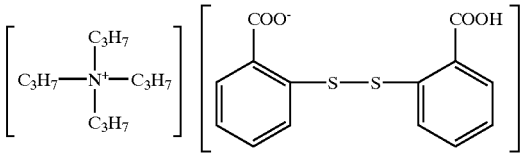

Compound (3-2)

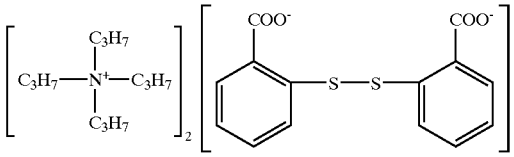

It is preferable, when the nigrosine dye and the quaternary ammonium salt compound are employed together, that the weight ratio of the employed nigrosine dye to the employed quaternary ammonium salt compound be in a range of 1/9 to 9/1, and in particular, in a range of 2/8 to 8/2. The nigrosine dye has a high capacity to apply a positive charge, but is liable to cause poor uniformity and poor stability of charging. When it is employed alone, fogging is liable to occur, resulting in a printed image with poor sharpness. On the other hand, the quaternary ammonium salt compound exhibits superior uniformity and stability of charging, but has a low capacity to apply a positive charge. By virtue of employing the quaternary ammonium salt compound in combination with the nigrosine dye, it is possible to stably obtain a clear printed image, which does not exhibit fogging during continuous printing. When the weight ratio of the employed nigrosine dye to the employed quaternary ammonium salt compound is below 1, it becomes difficult to achieve sufficient charge in the toner, and for this reason, the efficiency of transferring to the paper is liable to be lowered, thus obtaining a low quality image with poor uniformity at the solid portion and a poor resolution in the peripheral portion. In addition, as a result of the influence of low charging, scattering of the toner is increased. On the other hand, when the weight ratio exceeds 9, the charge amount is too high, and for this reason, there is obtained a developer which often causes fogging and gives a printed image with a low density and a low image quality during continuous printing.

As described above, when either one of the nigrosine dye or the quaternary ammonium salt compound is employed in amounts which are too large or too small, the desired charge amount cannot be obtained, resulting in a developer which gives a printed image with a low density and a low image quality and causes scattering of the toner. By appropriately adjusting the ratio between both components, there can be obtained a developer with long shelf life, which attains the optimum charge amount and causes no fogging, as well as one which is capable of printing a clear image with clear outlines, high density, and high quality, and also causes no scattering of the toner.

The positive charge control agent is employed preferably in an amount of 0.3 to 10 parts by weight with respect to 100 parts by weight of the binder resin, and more preferably in an amount of 1 to 5 parts by weight with respect to 100 parts by weight of the binder resin.

Furthermore, for use in heat roller fixation, in order to prevent trouble arising from the deposition of toner onto and contamination of the heat roller (offset), various waxes may be employed as auxiliaries which increase the releasing effects, as necessary. For example, natural waxes such as montanic ester wax, or polyolefin waxes such as high pressure method polyethylene and polypropylene may be employed.

Among the waxes described above, carnauba wax, montanic ester wax, rice wax and/or wax from scale insects are particularly preferably employed in the present invention. These waxes exhibit the best dispersability in the polyester resin having the structure according to the present invention, and allow for extreme improvements in fixation properties and anti-offset properties.

With regard to the carnauba waxes, a carnauba wax wherein the free aliphatic acids have been removed by purification is preferably employed. The acid value of the carnauba wax wherein the free aliphatic acids have been removed is preferably in a range of eight or less, and more preferably in a range of five or less. The carnauba wax wherein the free aliphatic acids have been removed may form smaller microcrystals than conventional carnauba wax, and for this reason, the improved dispersability in the polyester resin may be obtained. The montanic ester wax is refined from minerals, and as a result of the purification, it forms microcrystals in the same way as the carnauba wax, thus increasing its dispersability in the polyester resin. It is preferable that the acid value of this montanic ester wax be in a range of 30 or less.

In addition, the rice wax is refined from rice husk wax, and the acid value thereof is preferably in a range of 13 or less. The scale insect wax may be obtained by dissolving the wax components secreted by young scale insects (also termed Chinese wax insects) in, for example, hot water; separating the supernatant from the mixture; and then cooling, followed by solidification, or by repeating these steps. The scale insect wax refined in this manner is white in color when in a solid state, and exhibits an extremely sharp melting point. For this reason, the scale insect wax is suitable as the wax for the toner in the present invention. By virtue of the purification, the acid value thereof is in a range of 10 or less, and a value ranging 5 or less is preferable for use as the toner.

The waxes described above may be employed alone or in combination therewith. By including the waxes in an amount of 0.3 to 15 parts by weight, and preferably in an amount of 1 to 5 parts by weight, with respect to the weight of the binder resin, it is possible to achieve satisfactory fixation and offset properties. When the amount of the waxes is below 0.3 parts by weight, the anti-offset properties become poor. On the other hand, when the amount exceeds 15 parts by weight, the fluidity of the toner becomes poor, and furthermore, spent carrier occurs as a result of deposition on the surface of the carrier, exerting an adverse effect on the charge characteristics of the toner.

Furthermore, besides the natural waxes described above, synthetic ester waxes may also be advantageously employed. Among these synthetic ester waxes, tetrabehenic ester of pentaerythritol and the like are included. In addition, it is possible to simultaneously employ synthetic waxes such as polypropylene wax, polyethylene wax, and the like.

The toner of the present invention may be obtained by extremely common manufacturing methods, and does not require special manufacturing methods. For example, it is possible to obtain the toner of the present invention by first melting and kneading the resin and the colorant at a temperature above the melting point (the softening point) of the resin, subsequently pulverizing, and classifying the pulverized matter.

Concretely, for example, the resin and the colorant described above are employed as essential components, and the components are mixed by means of a kneading means such as two rollers, three rollers, a pressure kneader, a twin-screw extruder, or the like. At this time, if the colorant is uniformly dispersed in the resin, the melting and kneading conditions are not particularly restricted; however, these are commonly at a temperature ranging from 80 to 180° C. and for 30 seconds to 2 hours. A flushing treatment may be carried out in advance so that the colorant is uniformly dispersed in the resin, or alternatively, this may be mixed and kneaded at high concentrations with the resin in a master batch.

Next, after the kneaded mixture is allowed to cool down, it is pulverized in a pulverizer such as a jet mill or the like, and is subsequently classified by means of an air classifier or the like.

The average particle size of the particles for forming the base material of the toner is not particularly restricted; however, this is normally adjusted in a range of 5 to 15 $\mu$m.

Commonly, external additives may be mixed with the toner base material obtained in this manner, by means of a mixer such as a Henschel mixer.

The external additives may be employed in order to improve the surface properties of the toner base material, such as for an increase in the fluidity of the toner, for an improvement in the charge characteristics thereof, or the like. Examples of the external additives employed in the present invention include, for example, inorganic microparticles such as silicon dioxide, titanium oxide, alumina, and the like, as well as the products wherein the surface thereof is treated by a hydrophobic treating agent such as a silicone oil or the like, and resin microparticles, or the like.

As an example of silica, mention may be made of silicon dioxides having hydrophobic properties, such as the hydrophobic silicon dioxide wherein the surface thereof have been treated to be hydrophobic by means of various polyorganosiloxanes or silane coupling agents. Such a product is commercially available under, for example, the following trade names:

AEROSIL R972, R974, R202, R805, R812, RX200, RY200, R809, RX50, RA200HS, RA200H (Nippon Aerosil Corporation)

WACKER HDK K2000, H2050EP, HDK H3050EP, HVK2150 (Wacker Chemicals East Asia Ltd.)

Nipsil SS-10, SS-15, SS-20, SS-50, SS-60, SS-100, SS-50B, SS-50F, SS-10F, SS-40, SS-70, SS-72F (Nippon Silica Industries Co.)

CARBOSIL TG820F (Cabot Specialty Chemicals Inc.)

In addition, the external additives are employed commonly in a proportion of 0.05 to 5% by weight with respect to the weight of the toner base material, and preferably in a proportion of 0.1 to 3% by weight with respect to the weight of the toner base material.

Two or more silicas having different average particle sizes may be simultaneously employed. Furthermore, the silicas employed is commonly in a proportion of 0.05 to 5% by weight with respect to the weight of the toner base material, and preferably in a proportion of 0.1 to 3% by weight with respect to the weight of the toner base material.

The developer for electrostatic image development according to the present invention comprises a toner including colored resin particles and a magnetic carrier having a resin layer including a resistance control agent, which is formed on the surface of the carrier core material, wherein the resin layer of the carrier has a concentration gradient of the resistance control agent toward the thickness direction of the resin layer, a concentration of the resistance control agent is the highest in the vicinity of the carrier core material, and is gradually lowered toward the surface of the resin layer, and the resistance control agent is present on the surface of the resin layer.

The core agent of the carrier employed in the present invention may be the iron powder, magnetite, ferrite, or the like which is commonly employed in the two-component development method. Among these, ferrite or magnetite which has a low true specific gravity and a high resistance, exhibits superior environmental stability, and is easy to make spherical, thus exhibiting good fluidity, is preferably employed. Any shapes of the core agent which are spherical, or unspecified may be employed. The average particle size of the core agent is generally in a range of 10 to 500 $\mu$m, and preferably in a range of 30 to 80 $\mu$m in order to print high-resolution images.

In addition, examples of the coating resins for use in coating these core agents include, for example, polyethylene, polypropylene, polystyrene, polyacrylonitrile, polyvinyl acetate, polyvinyl alcohol, polyvinyl butyral, polyvinyl chloride, polyvinyl carbazole, polyvinyl ether polyvinyl ketone, vinyl chloride/vinyl acetate copolymer, styrene/acrylic copolymer, straight silicon resin comprising organosiloxane bonds or the modified derivatives thereof, fluorine resin, (meth)acrylic resin, polyester, polyurethane, polycarbonate, phenol resin, amino resin, melamine resin, benzoguanamine resin, urea resin, amide resin, epoxy resin, and the like. Among these, silicon resin, fluorine resin, and (meth)acrylic resin have superior charge stability and superior coating strength and, and therefore, may be preferably employed. In other words, as the carrier coated with the resin for use in the present invention, a magnetic carrier coated with a resin wherein ferrite or magnetite is employed as the core agent and one or more resins selected from a group consisting of silicone resin, fluorine resin, and (meth)acrylic resin is employed as the resin for coating the core agent, is preferred. As the resin for coating the core agent, in particular, silicone resin is preferred.

As an example of the resistance control agents to be dispersed in the resins described above, mention may be made of a carbon black such as acetylene black, channel black, furnace black, Ketjen black,. or the like; a metal carbide such as SiC, TiC, or the like; a metal nitride such as BN, NbN, TiN, or the like; a metal boride such as MoB, CrB, $TiB_2$, or the like; a metal oxide such as ZnO, $TiO_2$, $SnO_2$, or the like; and a metal microparticle such as Al, Ni, or the like. The number-average particle size of the resistance control agent described above is in a range of 0.01 to 5 $\mu$m, and more preferably in a range of approximately 0.05 to 3 $\mu$m. This is measured by means of a transmission type electron microscope.

Among these resistance control agents, the carbon black is preferred, and a carbon black having DBP absorption oil amount of 300 $cm^3$/100 g or more is the most preferable. As an examples of such carbon blacks, mention may be made of Ketjen Black EC or Ketjen Black EC 600JD (produced by Ketjen Black International Co.) which is commercially available.

The carrier according to the present invention corresponds to a magnetic carrier having a resin layer including a resistance control agent, which is formed on the surface of the carrier core material, wherein the resin layer of the carrier has a concentration gradient of the resistance control agent toward the thickness direction of the resin layer, a concentration of the resistance control agent is the highest in the vicinity of the carrier core material, and is gradually lowered toward the surface of the resin layer; and the resistance control agent is present on the surface of the resin layer. The method for making a resin layer have a concentration gradient of the resistance control agent toward the thickness direction of the resin layer is not particularly restricted.

According to the preferred method, a resin-layer including a resistance control agent in an amount of 3 to 30% by weight is formed on the surface of the carrier core material so that the thickness of the resin-layer is in a range of 0.1 to 2.0 $\mu$m, and subsequently, other resin-layers are successively stacked thereon, with the proviso that each of the other resin-layers has a lower concentration than the resin-layer formed previously, and the topmost surface resin-layer includes the resistance control agent in an amount of 0.5 to 20% by weight and has a thickness ranging from 0.1 to 2.0 $\mu$pm. The number of the resin-layers is most preferably in a range of 2 layers to 4 layers. The thickness of the entire coating layers (the entire resin-layers which correspond to a resin layer) formed on the surface of the carrier is commonly in a range of 0.1 to 5.0 $\mu$m.

The method of coating the surface of the core material of the carrier with the resin including the resistance control agent is not particularly restricted; however, examples thereof include an impregnation method in which impregnation is carried out in a solution of the coating resin including the resistance control agent, a spray method in which the coating resin solution is sprayed onto the surface of the core material of the carrier, a fluidized bed method in which spraying is conducted while the carrier is entrained in moving air, or a kneader coater method in which the carrier core material and the resin coating solution are mixed in a kneader coater, and solvent is removed.

No particular restriction is made with respect to the solvent which is employed in the coating resin solution, insofar as it is capable of dissolving the coating resin. Examples of solvents which may be employed include, for example, toluene, xylene, acetone, methyl ethyl ketone, tetrahydrofuran, dioxane, and the like.

The proportion by weight of the toner containing colored resin particles to the magnetic carrier coated with the resin is not particularly restricted. Normally, the toner is employed in an amount of 0.5 to 15 parts by weight with respect to 100 parts by weight of the carrier.

EXAMPLES

In the following, the present invention will be explained in detail. However, the present invention is not restricted to these Examples. In the following Examples and Comparative Examples, "%" and "parts" indicate "% by weight" and "parts by weight", respectively, unless otherwise specified.

Resin Synthesis Example 1

| | |
|---|---|
| Terephthalic acid | 2.0 parts by mol |
| Isophthalic acid | 2.5 parts by mol |
| Trimellitic acid | 0.5 parts by mol |
| Polyoxyethylene-(2.0)-2,2-bis(4-hydroxyphenyl)propane | 4.0 parts by mol |
| Ethylene glycol | 1.2 parts by mol |

The starting materials described above were charged in a four-necked flask equipped with a stirrer, a condenser, and a thermometer, and dibutyltin oxide was added thereto in an amount of 0.07 parts by weight relative to the total weight of the total acid ingredients, in a stream of nitrogen gas. The reaction was carried out for 15 hours at 220° C., while the water produced by dehydration condensation was being removed. The obtained polyester resin had a softening point of 155° C., determined by the ring and ball type softening point measuring method, a Tg of 62° C., determined by the DSC measuring method, and an acid value of 10.

Resin Synthesis Example 2

A polyester resin according to Resin Synthesis Example 2 was prepared in a manner similar to that of Resin Synthesis Example 1 employing the starting materials described below.

| | |
|---|---|
| Terephthalic acid | 2.5 parts by mol |
| Isophthalic acid | 2.5 parts by mol |
| Trimethylolpropane | 0.5 parts by mol |
| Polyoxyethylene-(2.0)-2,2-bis(4-hydroxyphenyl)propane | 3.5 parts by mol |
| Ethylene glycol | 1.0 parts by mol |

The obtained polyester resin had a softening point of 150° C., determined by the ring and ball type softening point measuring method, a Tg of 61° C., determined by the DSC measuring method, and an acid value of 6.

Resin Synthesis Example 3

| | |
|---|---|
| Styrene | 320 parts by weight |
| Butyl acrylate | 60 parts by weight |
| Methacrylic acid | 20 parts by weight |
| Azobisisobutyronitrile | 4 parts by weight |
| Xylene | 600 parts by weight |

The starting materials described above were introduced into a round-bottomed flask. The reaction was carried out for approximately 10 hours at 80° C. under a nitrogen atmosphere, and subsequently, the reaction mixture was allowed to heat up to 130° C., completing the polymerization. Subsequently, aluminum isopropoxide in an amount of 12 parts by weight was added thereto, and the mixture was reacted for approximately one hour. The reaction mixture was allowed to heat up to 180° C. under a reduced pressure of 0.5 mmHg by means of a vacuum pump, removing the solvent.

The obtained chelating cross-linked styrene-acrylic resin had a softening point of 145° C., determined by the ring and ball type softening point measuring method, a Tg of 61° C., determined by the DSC measuring method, and an acid value of 5.

Toner Preparation Example 1

| | |
|---|---|
| Resin according to Resin Synthesis Example 1 | 92 parts by weight |
| Carbon black "MOGUL L (produced by Cabot Specialty Chemicals Inc.)" | 5 parts by weight |
| Biscol 550P (produced by Sanyo Chemical Industries Ltd.) | 2 parts by weight |

-continued

| | |
|---|---|
| Charge control agent (positive charge control agent) "Bontron N-07 (produced by Orient Chemical Industries Incorporated)" | 1.5 parts by weight |
| "Quarternary ammonium salt compound (2-1)" | 1.5 parts by weight |

The raw materials described above were mixed in a Henschel mixer, and were kneaded in a twin-screw kneader. The kneaded mixture obtained in this manner was pulverized and classified to produce "Toner raw material A" having a volume-average particle size of 10.1 μm.

| | |
|---|---|
| "Toner raw material A" described above | 100 parts by weight |
| Silica HDK3050EP (produced by Wacker Chemicals Inc.) | 1 part by weight |

The raw materials described above were mixed in a Henschel mixer, and were sieved, producing Toner A.

Toner Preparation Example 2

| | |
|---|---|
| Resin according to Resin Synthesis Example 3 | 92 parts by weight |
| Carbon black "MOGUL L (produced by Cabot Specialty Chemicals Inc.)" | 5 parts by weight |
| Biscol 550P (produced by Sanyo Chemical Industries Ltd.) | 2 parts by weight |
| Charge control agent (positive charge control agent) "Bontron N-07 (produced by Orient Chemical Industries Incorporated)" | 1.5 parts by weight |
| "Quaternary ammonium salt compound (3-1)" | 1.5 parts by weight |

The raw materials described above were mixed in a Henschel mixer, and were kneaded in a twin-screw kneader. The kneaded mixture obtained in this manner was pulverized and classified to produce "Toner raw material B" having a volume-average particle size of 10.1 μm.

| | |
|---|---|
| "Toner raw material B" described above | 100 parts by weight |
| Silica HDK3050EP (produced by Wacker Chemicals Inc.) | 1 part by weight |

The raw materials described above were mixed in a Henschel mixer, and were sieved, producing Toner B.

Carrier Preparation Example 1

Ferrite particles having an average particle size of 100 μm in an amount of 10,000 parts were subjected to a fluidized layer spray coating with a mixture of 13 parts of a carbon black (Ketjen Black EC600DJ, produced by Ketjen Black International Co.) mixed with 400 parts of a silicone resin (SR2410, produced by Toray Silicone Co., solid parts: 20%). Immediately afterward, the coated ferrite particles were subjected to another fluidized layer spray coating with a mixture of 2 parts of a carbon black (Ketjen Black EC600DJ, produced by Ketjen Black International Co.) mixed with 100 parts of a silicone resin (SR2410, produced by Toray Silicone Co., solid parts: 20%). Subsequently, the coated ferrite particles were baked for 2 hours at 250° C., producing Carrier C.

Carrier Preparation Example 2

Ferrite particles having an average particle size of 100 μm in an amount of 10,000 parts were subjected to a fluidized layer spray coating with a mixture of 12 parts of a carbon black (Ketjen Black EC600DJ, produced by Ketjen Black International Co.) mixed with 350 parts of a silicone resin (SR2410, produced by Toray Silicone Co., solid parts: 20%). Immediately afterward, the coated ferrite particles were subjected to another fluidized layer spray coating with a mixture of 2.5 parts of a carbon black (Ketjen Black EC600DJ, produced by Ketjen Black International Co.) mixed with 100 parts of a silicone resin (SR2410, produced by Toray Silicone Co., solid parts: 20%). Immediately afterward, the coated ferrite particles were subjected to an additional fluidized layer spray coating with a mixture of one part of a carbon black (Ketjen Black EC600DJ, produced by Ketjen Black International Co.) mixed with 50 parts of a silicone resin (SR2410, produced by Toray Silicone Co., solid parts: 20%). Subsequently, the coated ferrite particles were baked for 2 hours at 250° C., producing Carrier D.

Carrier Preparation Example 3

Ferrite particles having an average particle size of 100 μm in an amount of 10,000 parts were subjected to a fluidized layer spray coating with a mixture of 17 parts of a carbon black (Ketjen Black EC600DJ, produced by Ketjen Black International Co.) mixed with 400 parts of a silicone resin (SR2410, produced by Toray Silicone Co., solid parts: 20%). Immediately afterward, the coated ferrite particles were subjected to another fluidized layer spray coating with a mixture of 1.7 parts of a carbon black (Ketjen Black EC600DJ, produced by Ketjen Black International Co.) mixed with 100 parts of a silicone resin (SR2410, produced by Toray Silicone Co., solid parts: 20%). Subsequently, the coated ferrite particles were baked for 2 hours at 210° C., producing Carrier E.

Carrier Preparation Example 4

Ferrite particles having an average particle size of 100 μm in an amount of 10,000 parts were subjected to a fluidized layer spray coating with a mixture of 10 parts of a carbon black (Ketjen Black EC600DJ, produced by Ketjen Black International Co.) mixed with 500 parts of a silicone resin (SR2410, produced by Toray Silicone Co., solid parts: 20%). Subsequently, the coated ferrite particles were baked for 2 hours at 250° C., producing Carrier F.

Carrier Preparation Example 5

Ferrite particles having an average particle size of 100 μm in an amount of 10,000 parts were subjected to a fluidized layer spray coating with a mixture of 16.3 parts of a carbon black (Ketjen Black EC600DJ, produced by Ketjen Black International Co.) mixed with 500 parts of a silicone resin JSR2410, produced by Toray Silicone Co., solid parts: 20%). Subsequently, the coated ferrite particles were baked for 2 hours at 250° C., producing Carrier G.

Carrier Preparation Example 6

Ferrite particles having an average particle size of 100 μm in an amount of 10,000 parts were subjected to a fluidized layer spray coating with a mixture of 8.5 parts of a carbon black (Ketjen Black EC600DJ, produced by Ketjen Black International Co.) mixed with 500 parts of a silicone resin (SR2410, produced by Toray Silicone Co., solid parts: 20%). Subsequently, the coated ferrite particles were baked for 2 hours at 210° C., producing Carrier H.

Carrier Preparation Example 7

Ferrite particles having an average particle size of 100 μm in an amount of 10,000 parts were subjected to a fluidized layer spray coating with a mixture of 13 parts of a carbon black (Ketjen Black EC600DJ, produced by Ketjen Black International Co.) mixed with 400 parts of a silicone resin (SR2410, produced by Toray Silicone Co., solid parts: 20%). Immediately afterward, the coated ferrite particles were subjected to another fluidized layer spray coating with 100 parts of a silicone resin (SR2410, produced by Toray Silicone Co., solid parts: 20%). Subsequently, the coated ferrite particles were baked for 2 hours at 250° C., producing Carrier I.

Preparation of Developer

| | |
|---|---|
| Toner A described above | 5 parts by weight |
| Carrier C (ferrite carrier coated with a silicon resin) | 95 parts by weight |

The materials described above were mixed and stirred to produce a developer according to "Example 1".

The developers according to Examples 1 to 3 and comparative developers according to Comparative Examples 1 to 4, each having a composition shown in Table 1, were produced in the same manner as described above.

TABLE 1

Examples of developers

| | Toner | Carrier |
|---|---|---|
| Example 1 | A | C |
| Example 2 | A | D |
| Example 3 | B | E |
| Comparative Example 1 | A | F |
| Comparative Example 2 | A | G |
| Comparative Example 3 | B | H |
| Comparative Example 4 | A | I |

With regard to the developers obtained in the Examples and Comparative Examples, a printing test was carried out as follows.

Printing Test:

Printing quality resulting from continuous printing employing a commercially available laser beam printer (equipped with a selenium photosensitive medium, developing rate: 20 m/min) was evaluated, as well as the amount of charge of the developer was measured. The amount of charge was measured by means of a blow-off charge amount measuring apparatus. The image density was measured by means of a Macbeth densitometer RD-918. Fogging was determined from the difference between the white background image density and the white paper density prior to printing.

The results are shown in Table 2.

TABLE 2

| | Evaluation results | | | | | | |
|---|---|---|---|---|---|---|---|
| | Printing test | Initial | 10 kP | 200 kP | 500 kP | 1000 kP | 1500 kP |
| Example 1 | Charge amount | 15 | 15 | 15 | 17 | 18 | 19 |
| | Image density | 1.4 | 1.5 | 1.5 | 1.4 | 1.5 | 1.4 |
| | Fogging | ○ | ○ | ○ | ○ | ○ | ○ |
| Example 2 | Charge amount | 15 | 16 | 16 | 17 | 17 | 18 |
| | Image density | 1.5 | 1.5 | 1.5 | 1.5 | 1.5 | 1.5 |
| | Fogging | ○ | ○ | ○ | ○ | ○ | ○ |
| Example 3 | Charge amount | 25 | 25 | 26 | 27 | 29 | 30 |
| | Image density | 1.4 | 1.5 | 1.4 | 1.5 | 1.4 | 1.4 |
| | Fogging | ○ | ○ | ○ | ○ | ○ | ○ |
| Comparative Example 1 | Charge amount | 16 | 16 | 17 | 20 | 25 | 30 |
| | Image density | 1.4 | 1.4 | 1.4 | 1.3 | 1.2 | 1.1 |
| | Fogging | ○ | ○ | ○ | ○ | ○ | ○ |
| Comparative Example 2 | Charge amount | 10 | 10 | 12 | 15 | 18 | 19 |
| | Image density | 1.6 | 1.6 | 1.5 | 1.5 | 1.5 | 1.5 |
| | Fogging | X | X | Δ | Δ | ○ | ○ |
| Comparative Example 3 | Charge amount | 25 | 25 | 26 | 30 | 36 | 40 |
| | Image density | 1.5 | 1.5 | 1.3 | 1.2 | 1.1 | 1.0 |
| | Fogging | ○ | ○ | ○ | ○ | ○ | Δ |
| Comparative Example 4 | Charge amount | 25 | 25 | 20 | 18 | 19 | 19 |
| | Image density | 1.0 | 1.0 | 1.3 | 1.4 | 1.5 | 1.5 |
| | Fogging | ○ | ○ | ○ | ○ | ○ | ○ |

The indications shown in the table are explained as follows.

"Charge amount"; $\mu$C/g

"Fogging": O: less than 0.01, Δ: 0.01 to less than 0.03, X: 0.03 or more

As is clear from Table 2, the developer for electrostatic image development according to the present invention, comprising: a toner for electrostatic image development which comprises a resin and a colorant; and a carrier formed by a carrier core material and a resin layer including a resistance control agent which is formed on the surface of the carrier core material, wherein the resin layer of the carrier has a concentration gradient of the resistance control agent toward the thickness direction of the resin layer, a concentration of the resistance control agent is the highest in the vicinity of the carrier core material, and is gradually lowered toward the surface of the resin layer, and the resistance control agent is present on the surface of the resin layer, exhibits the constant charge amount and image density, as well as little fogging in printing resistance tests.

What is claimed is:

1. A developer for electrostatic image development comprising: a toner for electrostatic image development which comprises a resin and a colorant; and a carrier formed by a carrier core material and a resin layer including a resistance control agent which is formed on the surface of the carrier core material, wherein the resin layer of the carrier has a concentration gradient of the resistance control agent toward the thickness direction of the resin layer, a concentration of the resistance control agent is the highest in the vicinity of the carrier core material, and is gradually lowered toward the surface of the resin layer, and the resistance control agent is present on the surface of the resin layer.

2. The developer for electrostatic image development as recited in claim 1, wherein said resin layer of the carrier comprises two or more resin-layers, each resin-layer having a different individual concentration of the resistance control agent, and the resistance control agent is included even in the topmost surface resin-layer.

3. The developer for electrostatic image development as recited in claim 1, wherein said resin layer of the carrier comprises a resin-layer formed on the surface of the carrier core material, which includes 3% by weight to 30% by weight of the resistance control agent and has a thickness of 0.1 $\mu$m to 2.0 $\mu$m, and another resin-layer which is the topmost surface resin-layer, including 0.5% by weight to 20% by weight of the resistance control agent and having a thickness of 0.1 $\mu$m to 2.0 $\mu$m.

4. The developer for electrostatic image development as recited in claim 1, wherein said resistance control agent is a carbon black.

5. The developer for electrostatic image development as recited in claim 1, wherein said toner additionally comprises a charge control agent, and the charge control agent is a nigrosine dye and/or a quaternary ammonium salt compound.

6. The developer for electrostatic image development as recited in claim 1, wherein said colorant for use in the toner is a carbon black.

7. An image forming method comprising a step of developing an electrostatic image at a developing speed of 20 m/min or higher, by means of employing the developer for electrostatic image development as recited in any one of claims 1 to 6.

* * * * *